US008120622B2

(12) United States Patent
Hargreaves et al.

(10) Patent No.: US 8,120,622 B2
(45) Date of Patent: Feb. 21, 2012

(54) PROXY DIRECT 3-D DEVICE AND REMOTE RENDERING

(75) Inventors: Shawn Hargreaves, Redmond, WA (US); John Mitchell Walker, Duvall, WA (US); Richard A. Meyer, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 1031 days.

(21) Appl. No.: 12/014,691

(22) Filed: Jan. 15, 2008

(65) Prior Publication Data

US 2009/0179917 A1 Jul. 16, 2009

(51) Int. Cl.
*G09G 5/00* (2006.01)

(52) U.S. Cl. ..... 345/629

(58) Field of Classification Search ..... None
See application file for complete search history.

(56) References Cited

U.S. PATENT DOCUMENTS 6,831,635 B2 * 12/2004 Boyd et al. ..... 345/418
6,945,870 B2 9/2005 Gatto
2005/0028166 A1 2/2005 Chew
2006/0287089 A1 12/2006 Addington
2007/0087829 A1 4/2007 Liu
2007/0184902 A1 8/2007 Liu
2008/0026847 A1 1/2008 Mueller
2008/0033734 A1 2/2008 Carry

OTHER PUBLICATIONS

Carson, Frank., "Microsoft expands XNA development platform with Live Functionality," Ars Technica, LLC, 1998, 1 page.
Microsoft, "Xbox XDK Overview," Xbox-Linux Org, http://www.xbox-linux.org/, 2002, pp. 1-6.
"Required Software," MSDN, http://www.msdn2.microsoft.com/en-us/library/bb203916(printer).aspx, 2005, pp. 1-2.

* cited by examiner

*Primary Examiner* — Ryan R Yang
(74) *Attorney, Agent, or Firm* — Woodcock Washburn LLP

(57) ABSTRACT

Systems, methods and computer readable media are disclosed for an overlaying requester to send graphics commands to a game connected to the overlaying requester via a dummy graphics application programming interface (API) object that the game will render over normal game-play graphics. In addition to allowing the overlaying requester to send graphics commands to the game in general, the dummy graphics API object can also limit the extent of the interaction between the overlaying requester and the computerized gaming system.

20 Claims, 19 Drawing Sheets

PROXY DIRECT 3-D DEVICE AND REMOTE RENDERING

BACKGROUND OF THE INVENTION

In recent years, online multi-player services for video games have exploded in popularity. For example, the popular XBOX LIVE® service made available by Microsoft Corporation of Redmond, Wash. allows gamers anywhere in the world to play with and against each other. Other online multi-player services presently include the PLAYSTATION NETWORK® service made available by Sony Corporation of America of Inglewood, Calif. and the WIICONNECT24® service made available by Nintendo of America Corporation of Redmond, Wash.

Frequently, such a service will wish to send graphics to be displayed by the game on the player's video output device, such as profile management, friends lists, messages, and game settings. To ensure that such things are rendered the same each time for the sake of consistency across games, the service must give to the game pre-rendered graphics. Since the service renders those graphics, but the game rendering happens inside of the game process, it is not possible to have the service render on top of the game directly. There then exists a need to enable the functionality of overlaying graphics rendered by the service on top of graphics rendered by the game.

SUMMARY OF THE INVENTION

This application is related by subject matter to U.S. patent application Ser. No. 12/014,680, internal reference number MSFT-6005, filed on Jan. 15, 2008.

In an example embodiment of the present disclosure, a method is provided to allow an overlaying requester that is connected to a game through a dummy graphics API object to overlay drawings on top of the game's visual output. The term "overlaying requestor" comprises executing computing devices. For instance, an overlaying requester may comprise, but is not limited to, another game, an online multi-player gaming service, or a remote desktop application. The overlaying requester may make resource calls to this dummy API object as if it would make calls directly to a game, so the overlaying requester need not be modified in any way for this method to operate properly. Once the dummy API object receives a resource request, it then passes that request on to the game's actual API object, which then renders the service's image overlaid upon the present game image. Under this method, the overlaying requester may have the game display graphical output where it would otherwise be unable to do so. In one embodiment, the overlaying requester comprises an online multi-player gaming service executing on separate computer hardware from the game and connected to the game via a computer network. This method includes, but is not limited to, initializing a dummy graphics application programming interface (API) object, initializing a dummy graphics application programming interface (API) object, initializing, by said graphics API object, a first communication link between an overlaying requester and said dummy graphics API object, initializing, by said graphics API object, a second communication link between said graphics API object and a game, receiving, by said graphics API object, a first data on said first communication link, sending, by said graphics API object, said first data on said second communication link, and displaying, by said graphics API object, on a visual output device, said first data overlaid on top of a second data from said In another example embodiment of the present disclosure, a system that is capable of performing a function equivalent to that of the above method includes, but is not limited to, a processor, a computer readable medium having a first stored instructions executable by said processor, said first instructions configured to cause said processor to exchange game information with an overlaying requester, and the computer readable medium having a second stored instructions further launching a graphics API object configured to intercept a first data transferred between the game and the overlaying requester. In addition to the foregoing, other aspects are described in the claims, drawings, and text forming a part of the present disclosure.

In another embodiment of the present disclosure, a computer readable storage medium having a plurality of instructions stored thereon is provided, which, when executed by a processor associated with a system containing stored files within a storage device associated with a receiving portal, command executor and rights verifier, cause the processor to perform the steps of, but is not limited to performing the steps of: executing a dummy graphics application programming interface (API) object, enabling a first communication link between an overlaying requester and said graphics API object, enabling by said graphics API object, a second communication link between a game and said graphics API object, receiving, by the graphics API object from the overlaying requester, a first data, sending, by said graphics API object, said first data on said second communication link, and causing said game to display, on a visual output device, said first data overlaid on top of a second data from said game. In addition to the foregoing, other system aspects are described in the claims, drawings, and text forming a part of the present application.

The foregoing is a summary and thus contains, by necessity, simplifications, generalizations and omissions of detail. Those skilled in the art will appreciate that the summary is illustrative only and is not intended to be in any way limiting.

BRIEF DESCRIPTION OF THE DRAWINGS

The systems, methods, and computer readable media for proxy 3D device and remote rendering in accordance with this specification are further described with reference to the accompanying drawings in which.

DETAILED DESCRIPTION OF ILLUSTRATIVE EMBODIMENTS

Certain specific details are set forth in the following description and figures to provide a thorough understanding of various embodiments of the invention. Certain well-known details often associated with computing and software technology are not set forth in the following disclosure, however, to avoid unnecessarily obscuring the various embodiments of the invention. Further, those of ordinary skill in the relevant art will understand that they can practice other embodiments of the invention without one or more of the details described below. Finally, while various methods are described with reference to steps and sequences in the following disclosure, the description as such is for providing a clear implementation of embodiments of the invention, and the steps and sequences of steps should not be taken as required to practice this invention.

Figure 17:
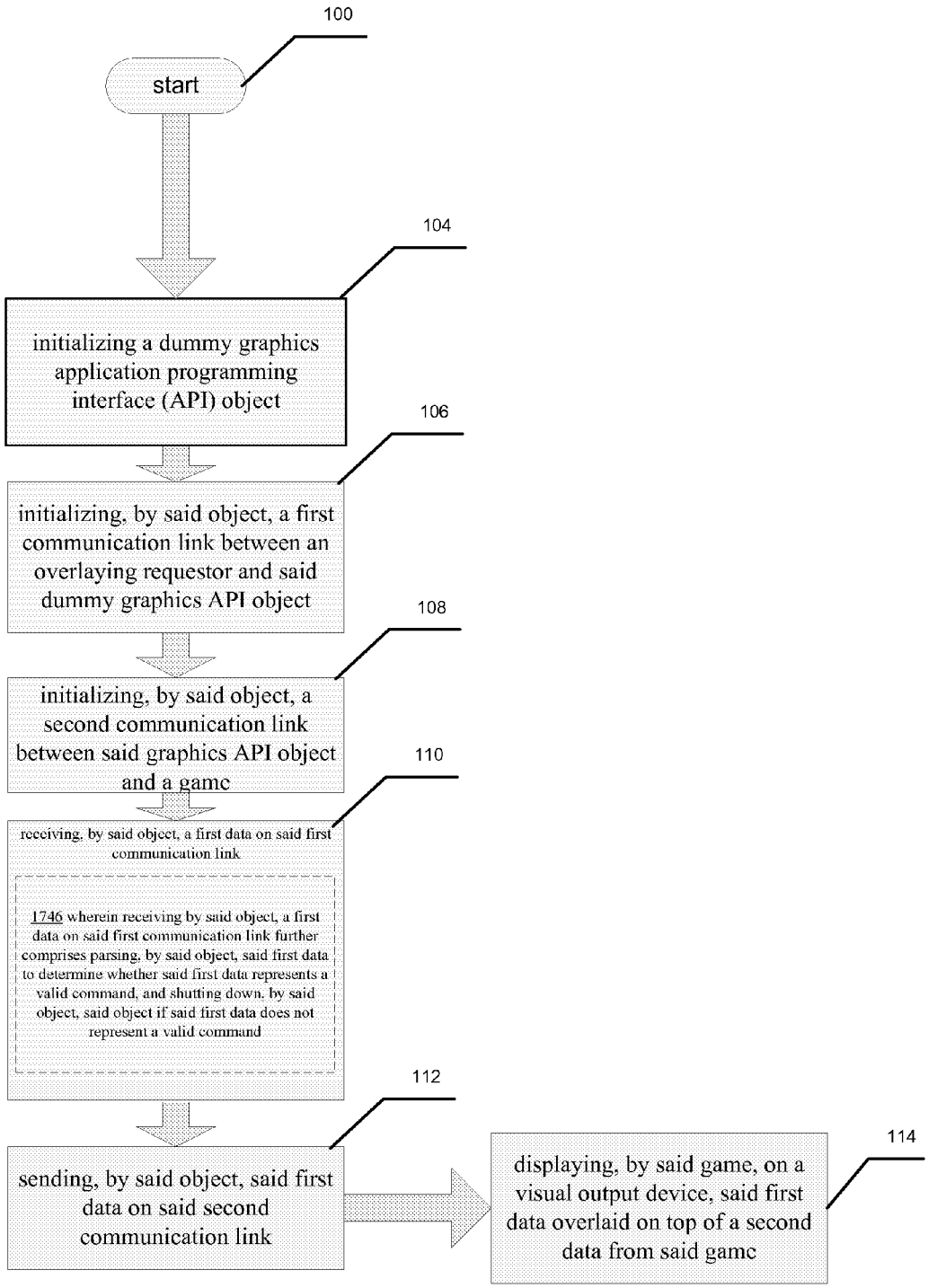
FIG. 17 illustrates an alternative embodiment of the example operational procedure of FIG. 1.
Figure 18:
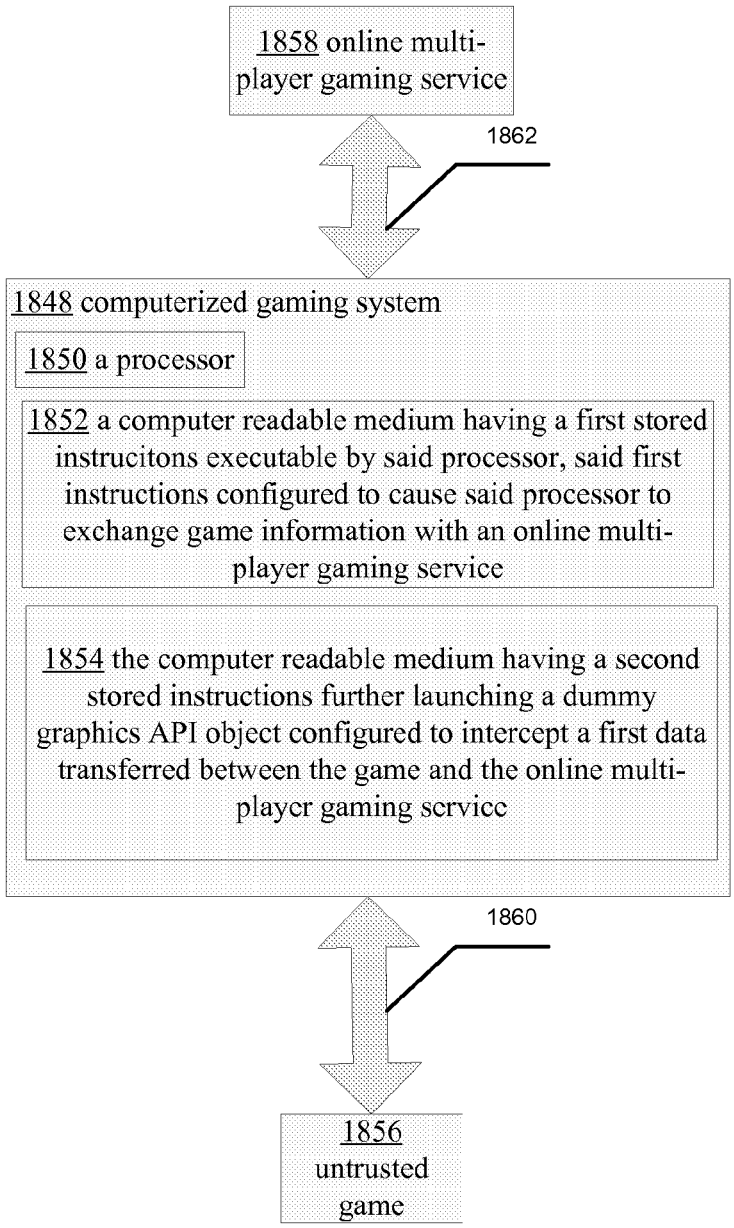
FIG. 18 illustrates an example system for proxy 3D device and remote rendering.
Figure 19:
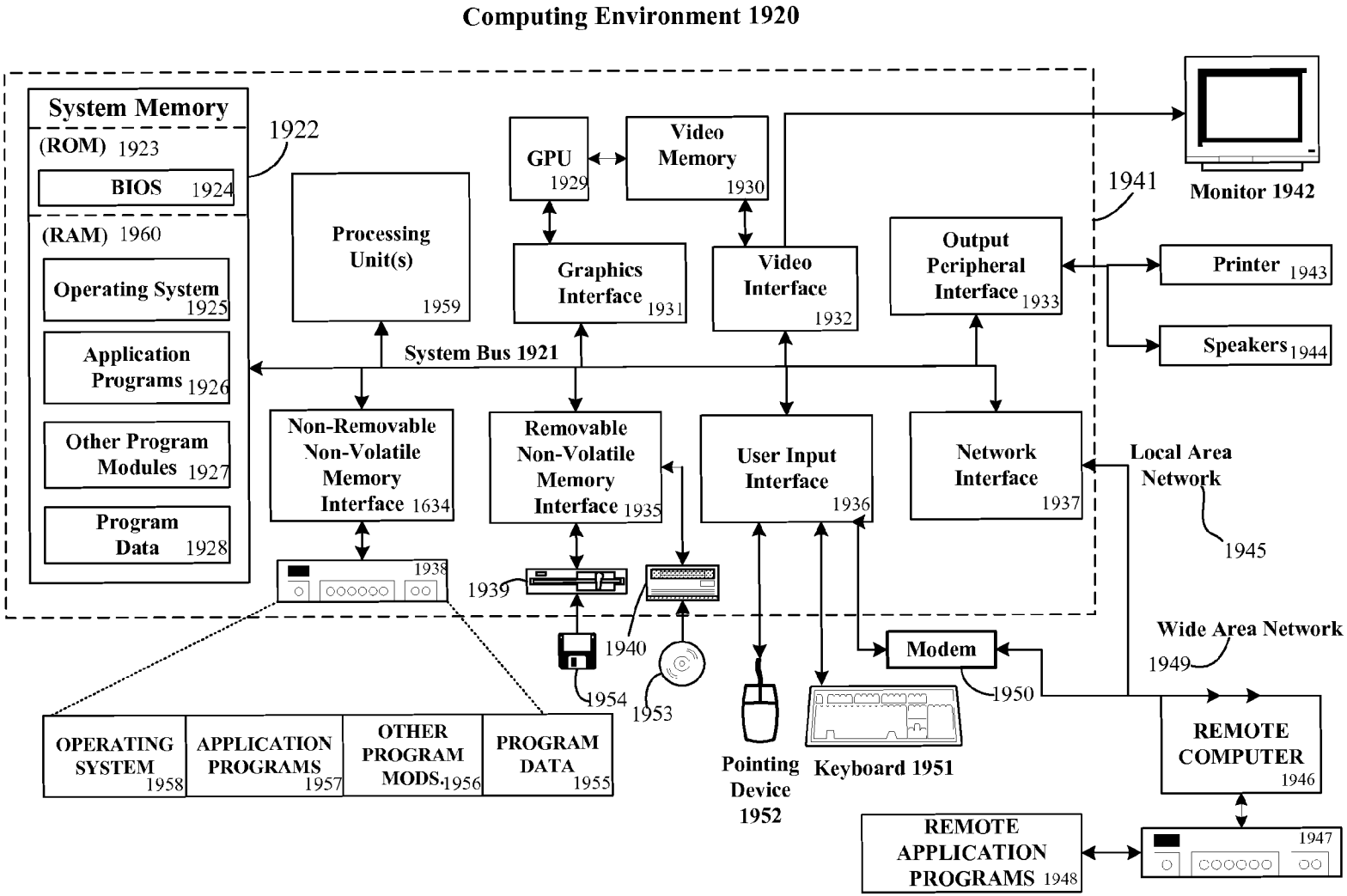
FIG. 19 illustrates an example system for proxy 3D device and remote rendering.

FIG. 1 through FIG. 17 provide operational procedures as may be performed in accordance with various embodiments of the invention, while FIGS. 18 and 19 illustrate exemplary systems that may perform such operational procedures.

Figure 1:
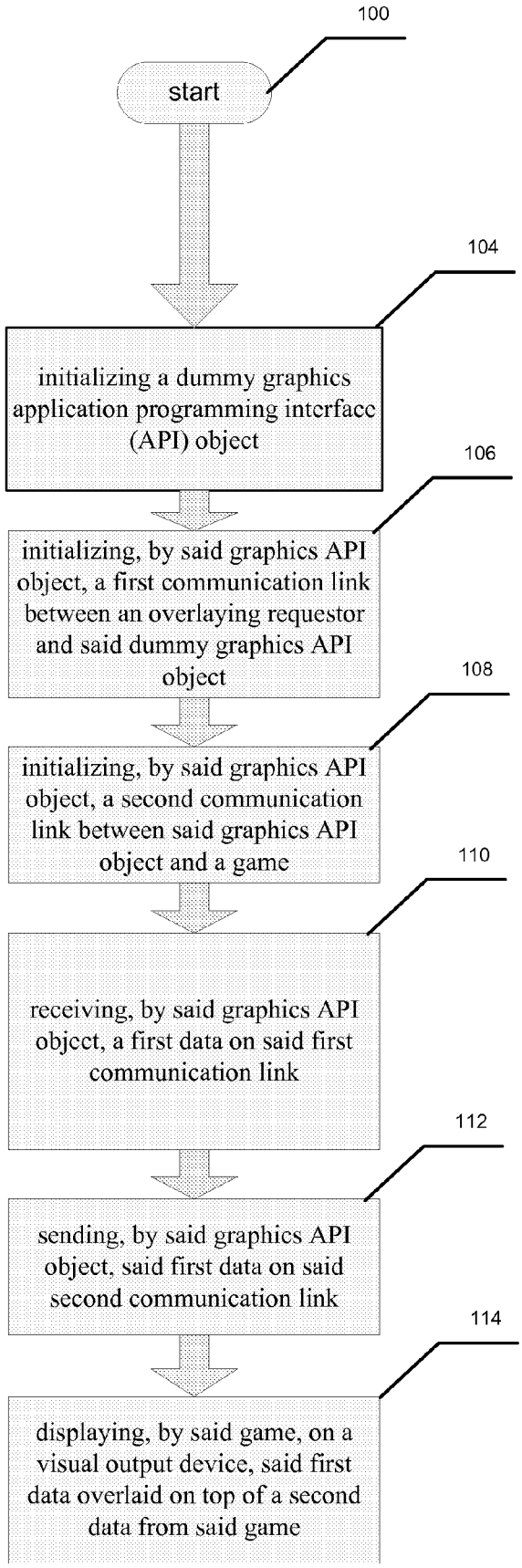
FIG. 1 illustrates an example operational procedure representing operations related to proxy 3D device and remote rendering.

FIG. 1 illustrates an example operational flow comprising operations 100-114 related to allowing an overlaying requester that is connected to a game through a dummy graphics API object to overlay drawings on top of the game's visual output. Those skilled in the art will note that operations 100-114 are illustrative in purpose and that different implementations can select appropriate operation(s) for such implementations.

Operation 100 begins the operational process Operation 100 can be triggered for example in response to a determination that a connection to an online gaming service is requested.

In an embodiment where the overlaying requester comprises an online multi-player gaming service, a game may attempt to connect to the online multi-player gaming services for a variety of reasons. Chief among them is for the purpose of interacting in the game between multiple players, such as two people in different locations each using a gaming system to connect to the online multi-player gaming service for the purpose of playing the same game against each other. Furthermore, once connected, the environment may be used as a communications device, either via text, audio or video and in real time or asynchronously.

As depicted by FIG. 1, operation 104 illustrates initializing a dummy graphics application programming interface (API) object. In one embodiment, this is an object that appears to the service to be an actual API object, and interfaces with the service in the same way that an actual object would act. However, unlike an actual API object, this dummy object lacks the ability to itself manipulate a visual output device. Instead, the object takes the data received from the overlaying requester (which is behaving as if it communicating directly with an actual graphics API object) and passes it on to the game, which contains an actual graphics API object. Within an operational environment such as those depicted in FIG. 18 or FIG. 19, a processor 1850 within a computerized gaming system 1848 may execute first stored instructions on a computer readable medium configured to launch a dummy graphics API object 1854. In some example embodiments of the present disclosure, the processor 1850 may include, but is not limited to, a general purpose microprocessor.

As depicted by FIG. 1, operation 106 illustrates initializing, by said graphics API object, a first communication link between an overlaying requester and said dummy graphics API object. Within an operational environment such as the one as depicted in FIG. 18 or FIG. 19, a processor 1850 within a computerized gaming system 1848 may initialize with the service 1858 a first communication link 1860. Initializing a communication link may involve, but is not limited to, the dummy graphics API object and the overlaying requester exchanging a data that establishes things such as the protocol to be used, the respective network ports to be used for the communication link, and the respective network addresses (such as internet protocol (IP) addresses) that the dummy graphics API object and the overlaying requester each possess.

In some example embodiments of the present disclosure, wherein both the dummy graphics API object and the overlaying requester are executing on the same computing environment, the communication link 1860 may include, but is not limited to, an inter-process communication (IPC) link. In another embodiment, the communication link may include, but is not limited to a network communications link, such as one that communicates via the transmission control protocol/internet protocol (TCP/IP).

As depicted by FIG. 1, operation 108 illustrates initializing, by said graphics API object, a second communication link between said graphics API object and a game. Within an operational environment such as the one as depicted in FIG. 18 or FIG. 19, a processor 1850 within a computerized gaming system 1848 may initialize with the game 1858 a second communication link 1862. In some example embodiments of the present disclosure, the communication link 1862 may include, but is not limited to, a transmission control protocol/internet protocol (TCP/IP) communication link. Initializing a communication link may involve, but is not limited to, the dummy graphics API object and the game exchanging a data that establishes things such as the protocol to be used, the respective network ports to be used for the communication link, and the respective network addresses (such as internet protocol (IP) addresses) that the dummy graphics API object and the game each possess.

In one embodiment, the game would lack notice that it was dealing with the dummy graphics API object and behaves as if it was communicating directly with the overlaying requester. In another embodiment, the game would have notice that it was dealing with the dummy graphics API object and behave in accordance with that notice.

As depicted by FIG. 1, operation 110 illustrates receiving, by said graphics API object, a first data on said first communication link. In one embodiment of the present disclosure, the first data may comprise a single data packet. In other embodiments, the first data may comprise a stream of data packets. Furthermore, for example, the first data may comprise a message or menu that the service wishes the game to display over the game itself on a visual output device.

As depicted by FIG. 1, operation 112 illustrates sending, by said graphics API object, said first data on said second communication link. In one embodiment of the present disclosure, this act of generating a modified data may comprise passing said first data to the game without manipulating it in any form. This would further the function of the dummy graphics API object acting transparently as to the overlaying requester, so that the overlaying requester believes it is communicating directly with the game.

As depicted by FIG. 1, operation 114 illustrates displaying, by said graphics API object, on a visual output device, said first data overlaid on top of a second data from said game. In one embodiment, this visual output device is the visual output device which the player is directly using to play the game. Furthermore, the first data may be overlaid upon the second data in a 3D manner, such as with the use of shadows to simulate distance between graphical layers.

FIG. 2 through FIG. 17 provide additional embodiments of the operation 100. One skilled in the art will recognize that the operational procedures illustrated in FIG. 2 through FIG. 17 are examples and other embodiments exist. Those skilled in the art will note that some operations in FIG. 2 through FIG. 17 are indicated by dashed lines, which in general, indicates that they are to be considered optional. More specifically, different implementations will typically employ one or more herein-described operations dependent upon context, and the selection of the appropriate operation(s) appropriate to the various context(s) is within the skill of one in the art in light of the teachings herein.

Figure 2:
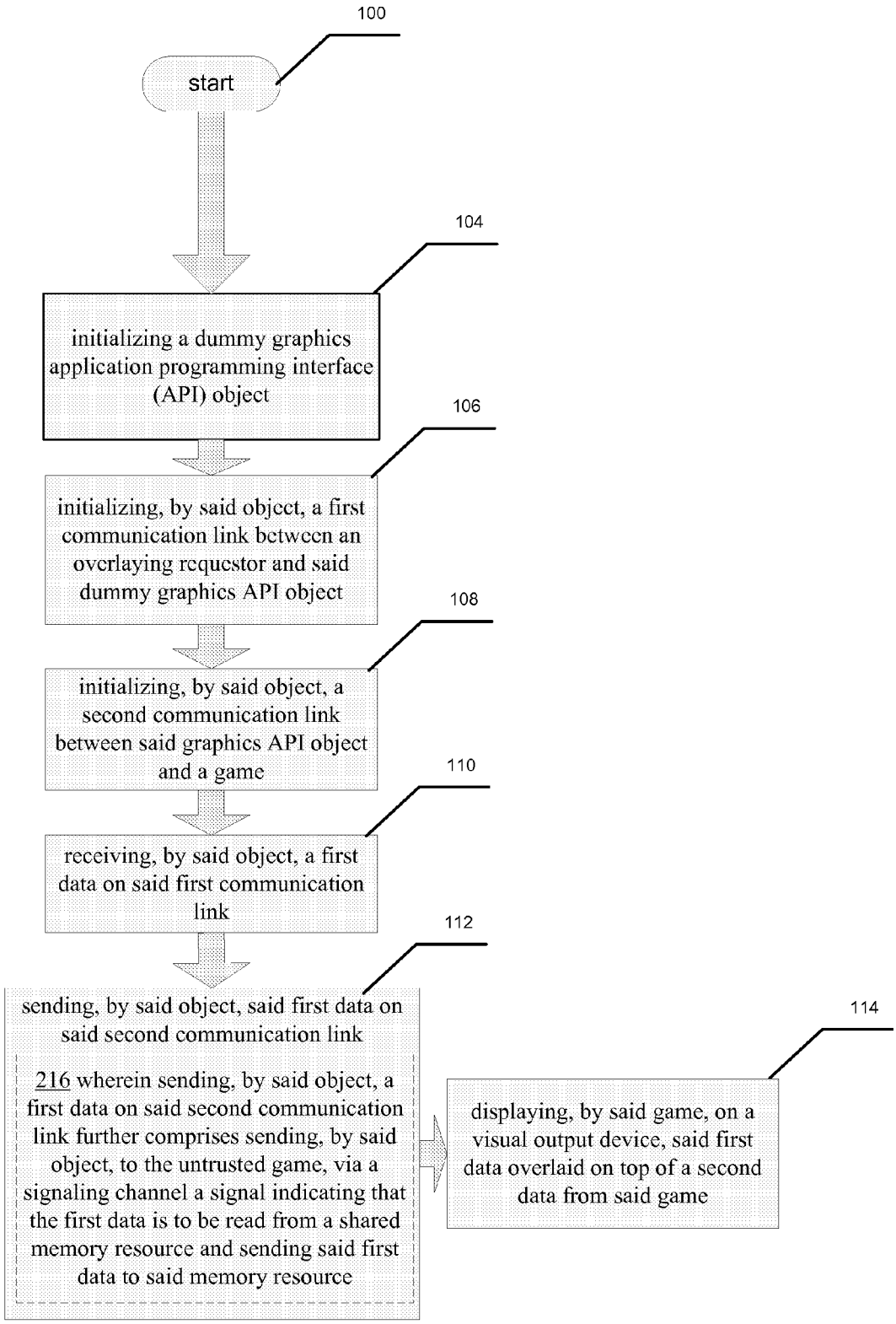
FIG. 2 illustrates an alternative embodiment of the example operational procedure of FIG. 1.

FIG. 2 illustrates an example of the operational procedure 100 of FIG. 1 including alternative operations including 216 and 218. In this example, sending, by said graphics API object, said first data on said second communication link includes both sending, by said graphics API object, to the game, via a signaling channel a signal indicating that the first data is to be read from a shared memory resource and sending said first data to said memory resource. In an embodiment of the present disclosure, the memory resource may be, but is not limited to, random access memory, L2 or L3 cache, and a magnetic hard disk. Furthermore, the signaling channel may be, but is not limited to, message passing, a semaphore, a pipe or a socket. The signal itself may be any form of data properly passed in accordance with the requirements of the implementation of the signaling channel.

Figure 3:
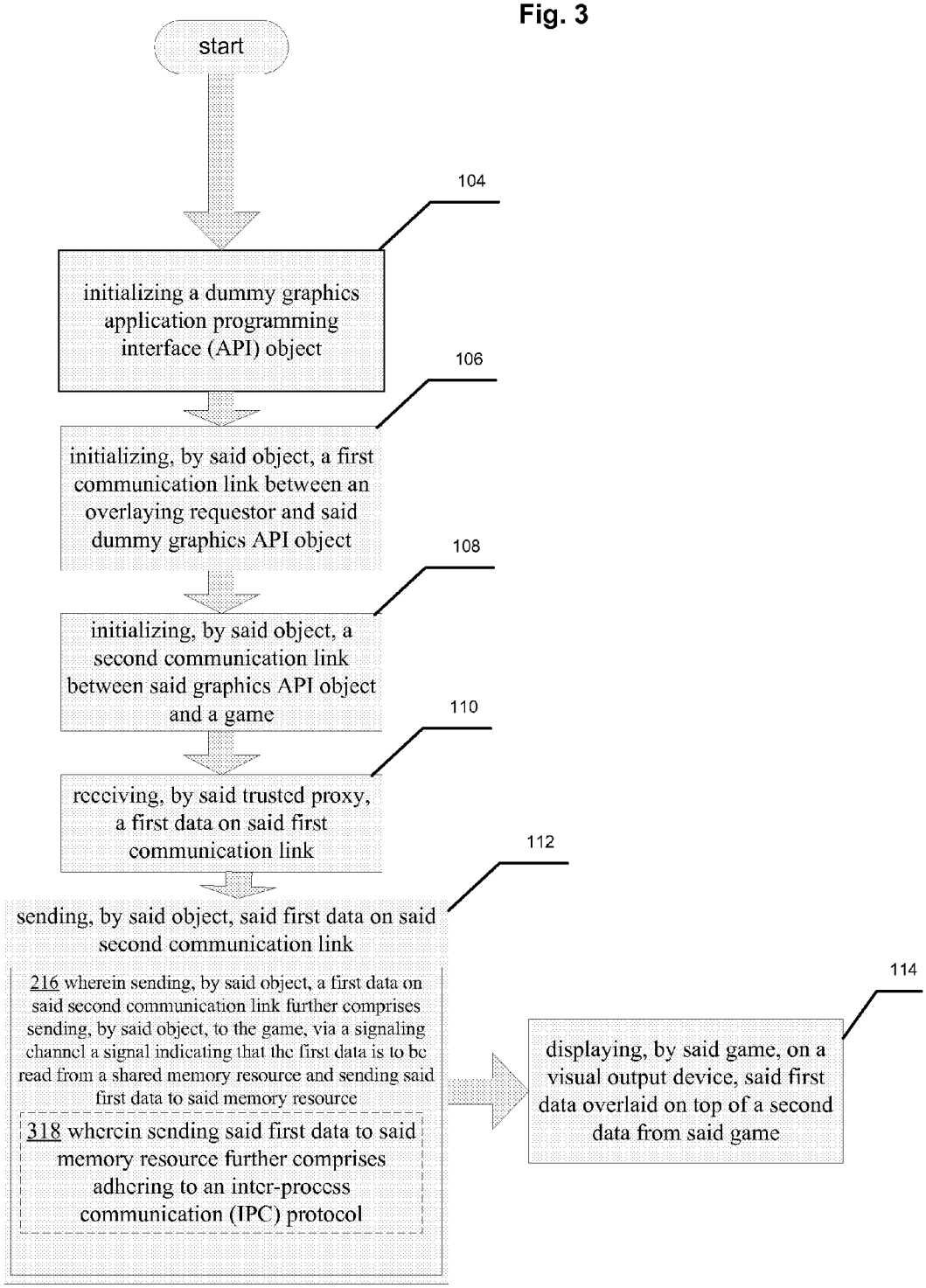
FIG. 3 illustrates an alternative embodiment of the example operational procedure of FIG. 2.

FIG. 3 illustrates an example of the operational procedure 100 including an alternative operation including 320. In this example, sending said first data to said memory resource includes adhering to an inter-process communication (IPC) protocol. In an embodiment of the present disclosure, the inter-process communication protocol may be, but is not limited to, anonymous pipes, named pipes, common object request broker architecture (COBRA), message bus (MBUS), sockets, and remote procedure call (RPC).

Figure 4:
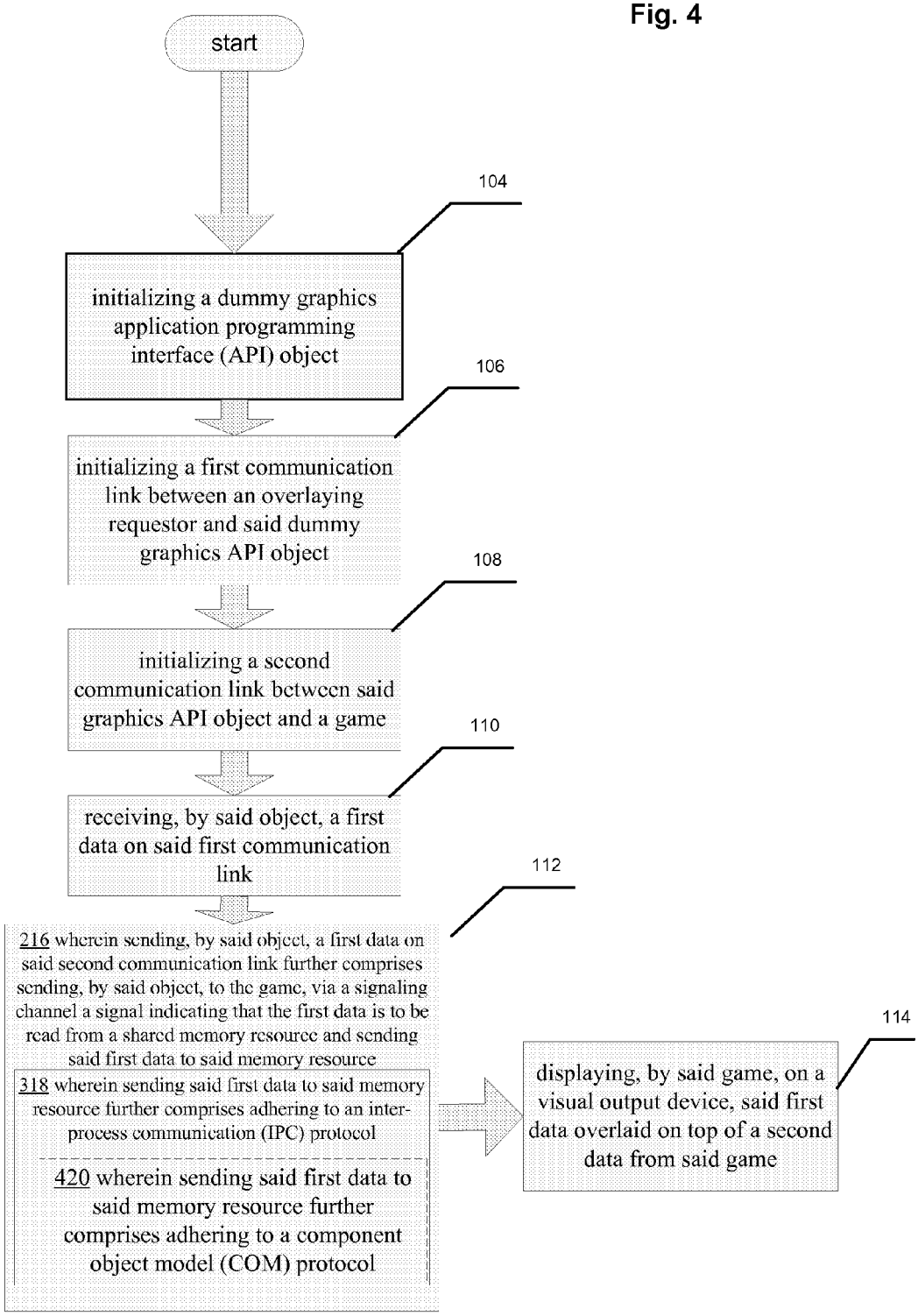
FIG. 4 illustrates an alternative embodiment of the example operational procedure of FIG. 3.

FIG. 4 illustrates an example of the operational procedure 100 of FIG. 3 including an alternative operation including 422. In this example, adhering to an inter-process communication (IPC) protocol includes adhering to a component object model (COM) protocol. In an embodiment of the present disclosure, this specifically allows the inter-process communication to take place across computing machine boundaries, as well as allows for dynamic memory resource creation.

Figure 5:
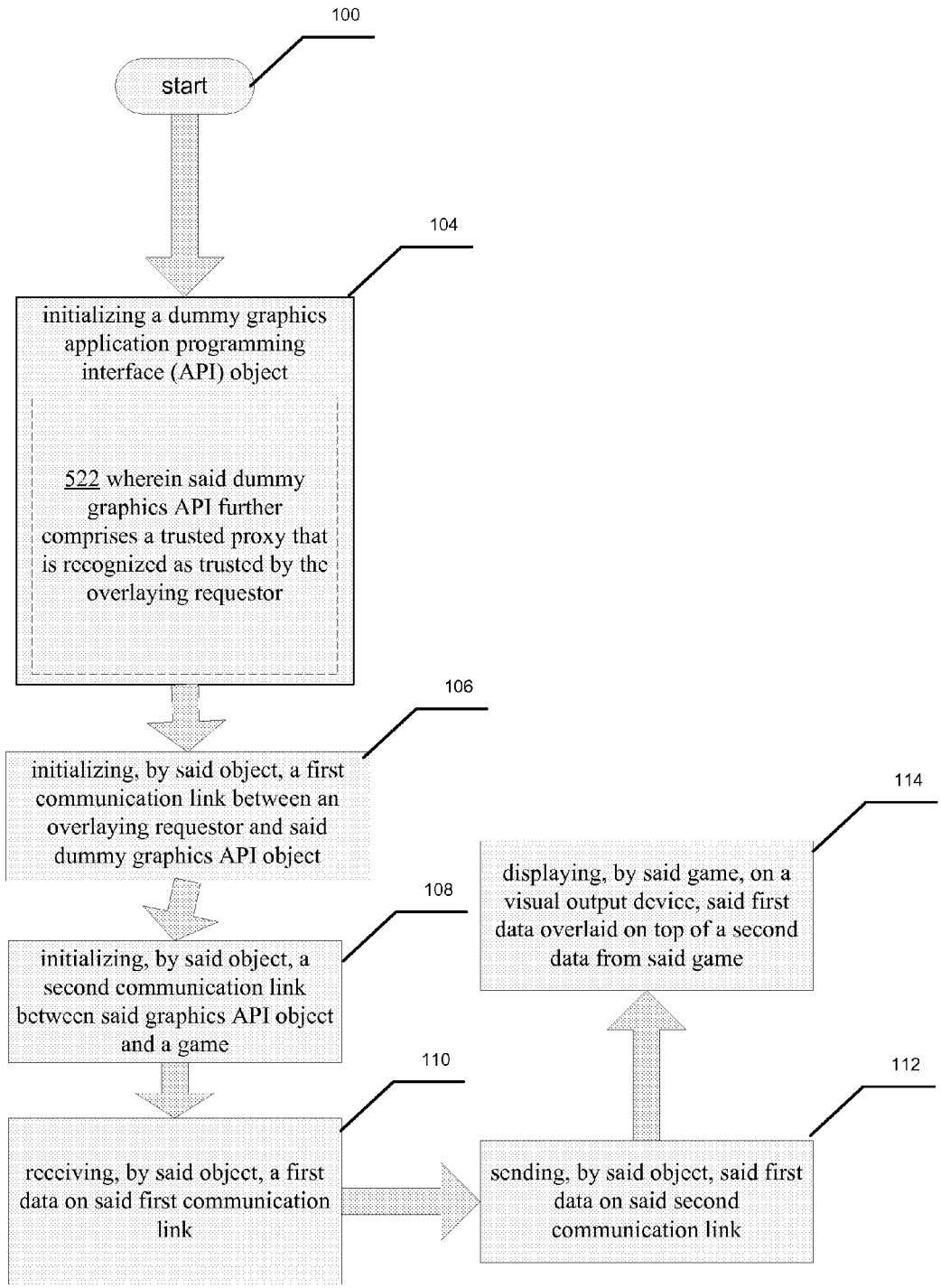
FIG. 5 illustrates an alternative embodiment of the example operational procedure of FIG. 1.

FIG. 5 illustrates an example of the operational procedure 100 including an alternative operation including 524. In this example, the dummy graphics API object includes a trusted proxy that is recognized as trusted by the overlaying requester. In an embodiment of the present disclosure, this may be, but is not limited to, appending said dummy graphics API object with a digital signature mechanism to verify the identity of the author or build system and a check-sum to verify that the object has not been modified. One skilled in the art would recognize that the above embodiments are examples and that other embodiments exist.

In the present context, "trusted" refers to a system or set of computer readable instructions, which contains some form of meta-data (possibly a check-sum) that attests to the fact that the computer readable instructions have not been modified since the meta-data has been added to them. The trusting object (here, the online-multi-player gaming service) can then be sure that the trusted computer readable instructions exist exactly as they did when the meta-data was added to them. Given that, a game may be considered "untrusted" when it does not qualify as trusted, for instance, if it lacks the aforementioned meta-data indicative of being trusted.

A trusted proxy, when loaded, acts as an intermediary between games and online gaming services. The trusted proxy could be "trusted" according to the meta-data techniques discussed above, or according to a variety of other techniques recognizable to one skilled in the art. The trusted proxy could exist on the same computing device as the game, as the online multi-player server, or on a computing device independent of either of those two devices.

Figure 6:
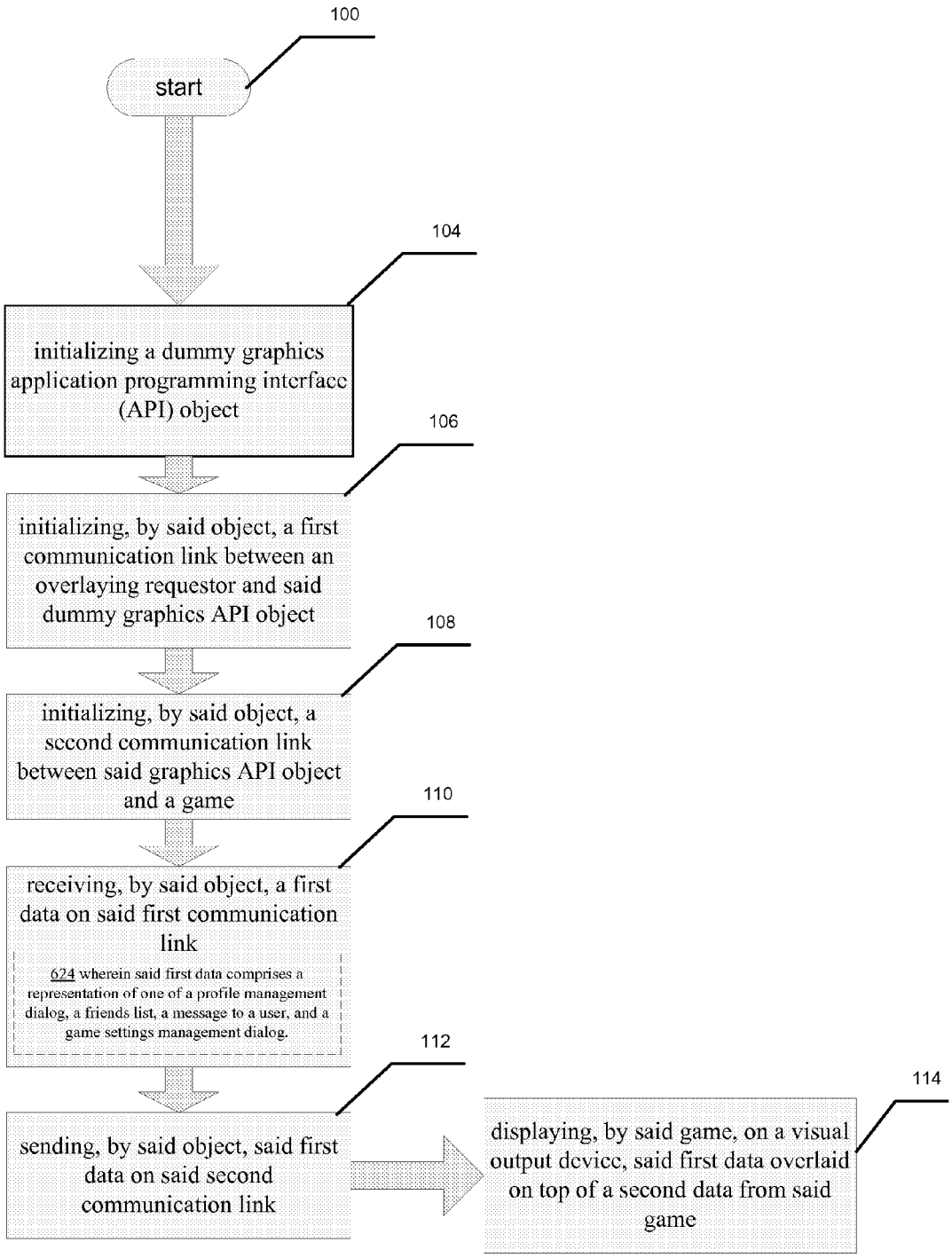
FIG. 6 illustrates an alternative embodiment of the example operational procedure of FIG. 1.

FIG. 6 illustrates an example of the operational procedure 100 including an alternative operation including 626. In this example, said first data includes a representation of one of a profile management dialog, a friends list, a message to a user, and a game settings management dialog. In an embodiment of the present disclosure, the first data may contain an indicator field that determines the type of information being transmitted, and a payload field which contains the information itself.

Figure 7:
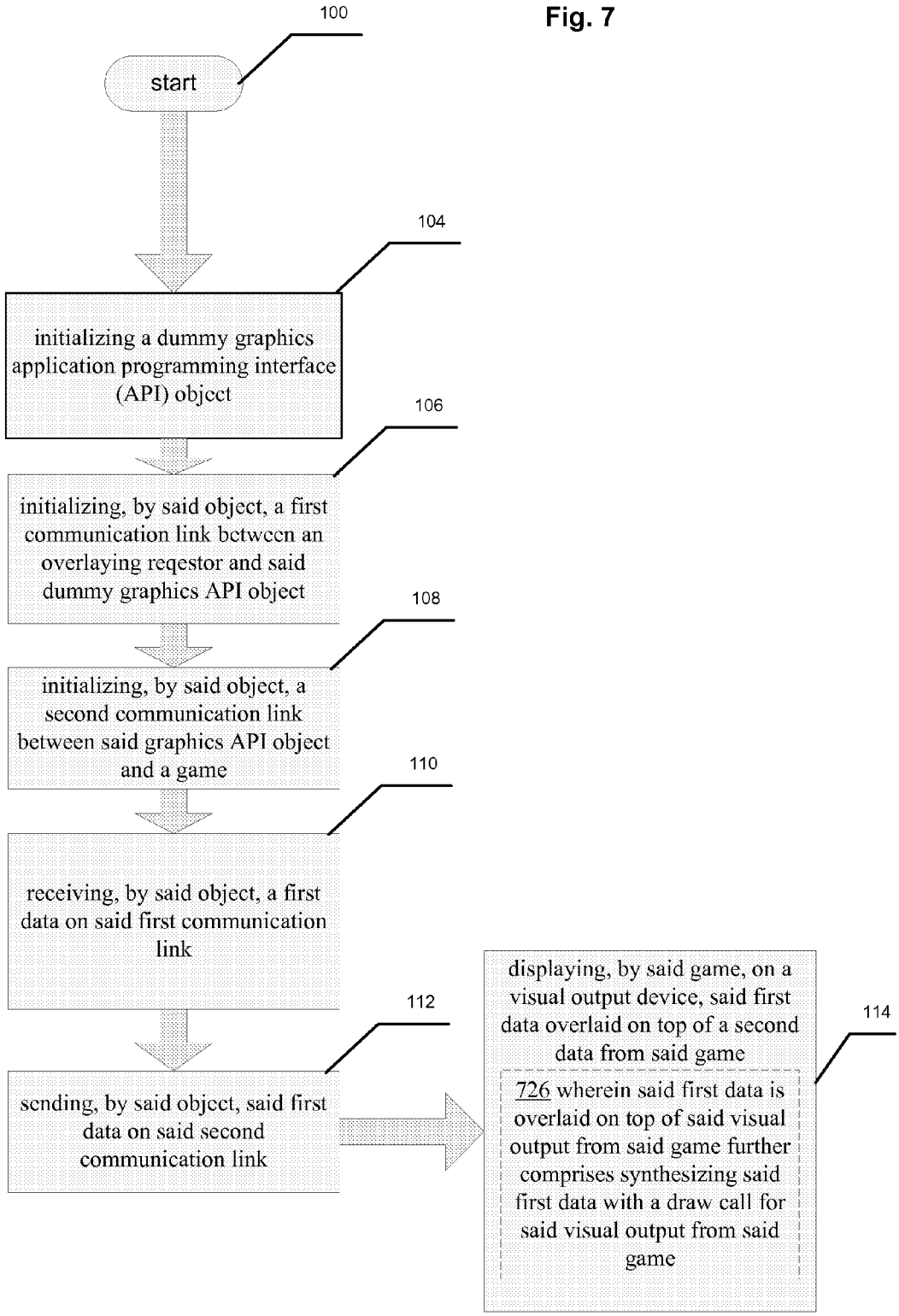
FIG. 7 illustrates an alternative embodiment of the example operational procedure of FIG. 1.

FIG. 7 illustrates an example of the operational procedure 100 including an alternative operation including 728. In this example, said first data is overlaid on top of said visual output from said game includes synthesizing said first data with a draw call for said visual output from said game. In an embodiment of the present disclosure, this may be, but is not limited to, overlaying said first data each time the game displays the visual output on the visual output device. One skilled in the art would recognize that the above embodiments are examples and that other embodiments exist.

Figure 8:
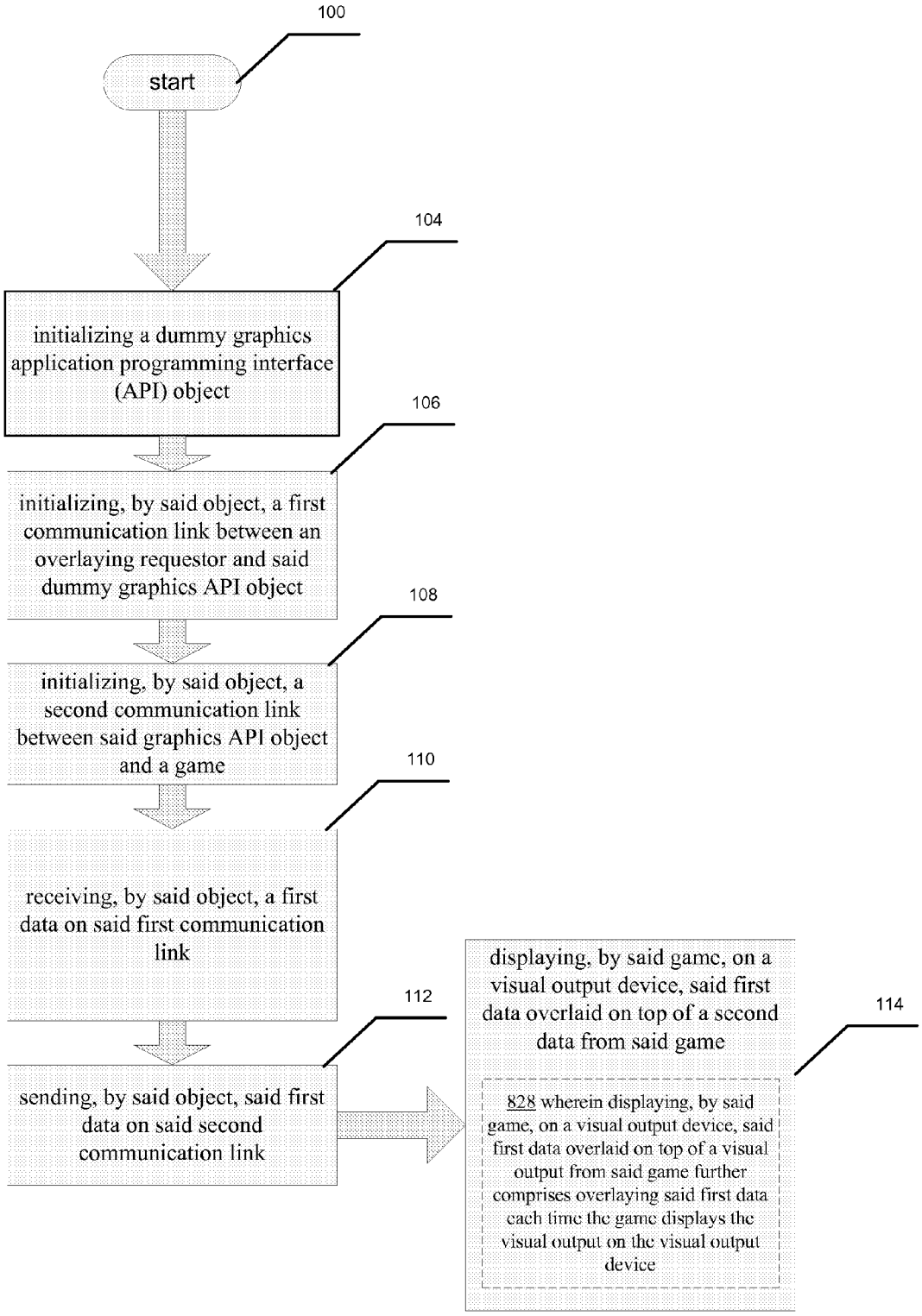
FIG. 8 illustrates an alternative embodiment of the example operational procedure of FIG. 1.

FIG. 8 illustrates an example of the operational procedure 100 including an alternative operation including 828. In this example, displaying, by said game, on a visual output device, said first data overlaid on top of a visual output from said game includes overlaying said first data each time the game displays the visual output on the visual output device. In an embodiment of the present disclosure, this may be, but is not limited to, retransmitting the first data for each refreshed frame on the visual output device.

Figure 9:
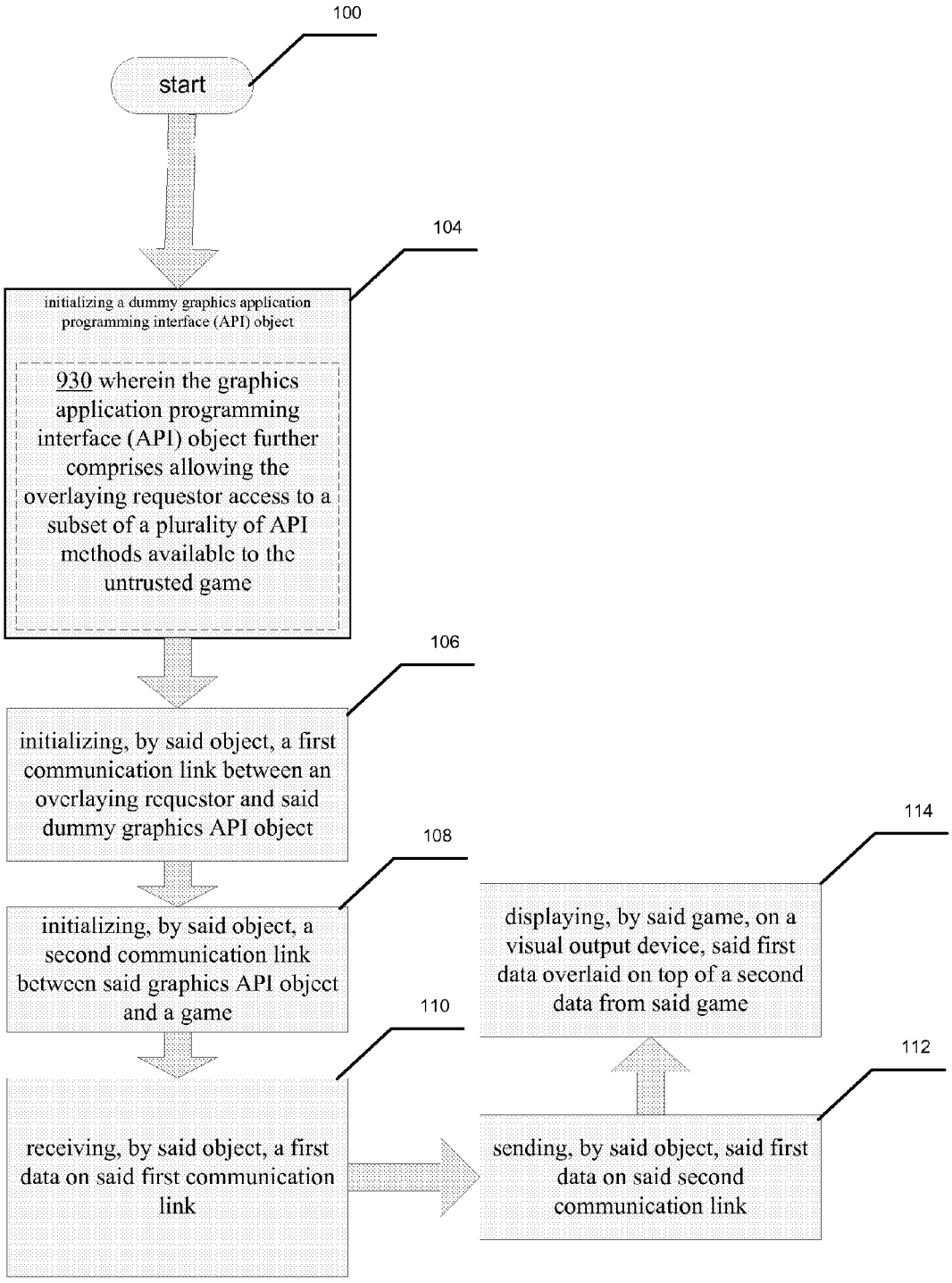
FIG. 9 illustrates an alternative embodiment of the example operational procedure of FIG. 1.

FIG. 9 illustrates an example of the operational procedure 100 including an alternative operation including 930. In this example, the dummy graphics API object includes allowing the overlaying requester access to a subset of a plurality of API methods available to the game. In an embodiment of the present disclosure, this may be, but is not limited to, allowing the overlaying requester access to such methods as creating a texture, creating a pixel shader, creating a vertex shader, creating a vertex declaration, setting a rendering state, setting a sampler state, setting a vertex shader constant, setting a pixel shader constant, setting a vertex declaration, setting a vertex shader, setting a pixel shader, setting a texture, and drawing a primitive. The advantage of such an implementation is that it greatly decreases the complexity of the dummy graphics API object.

Figure 10:
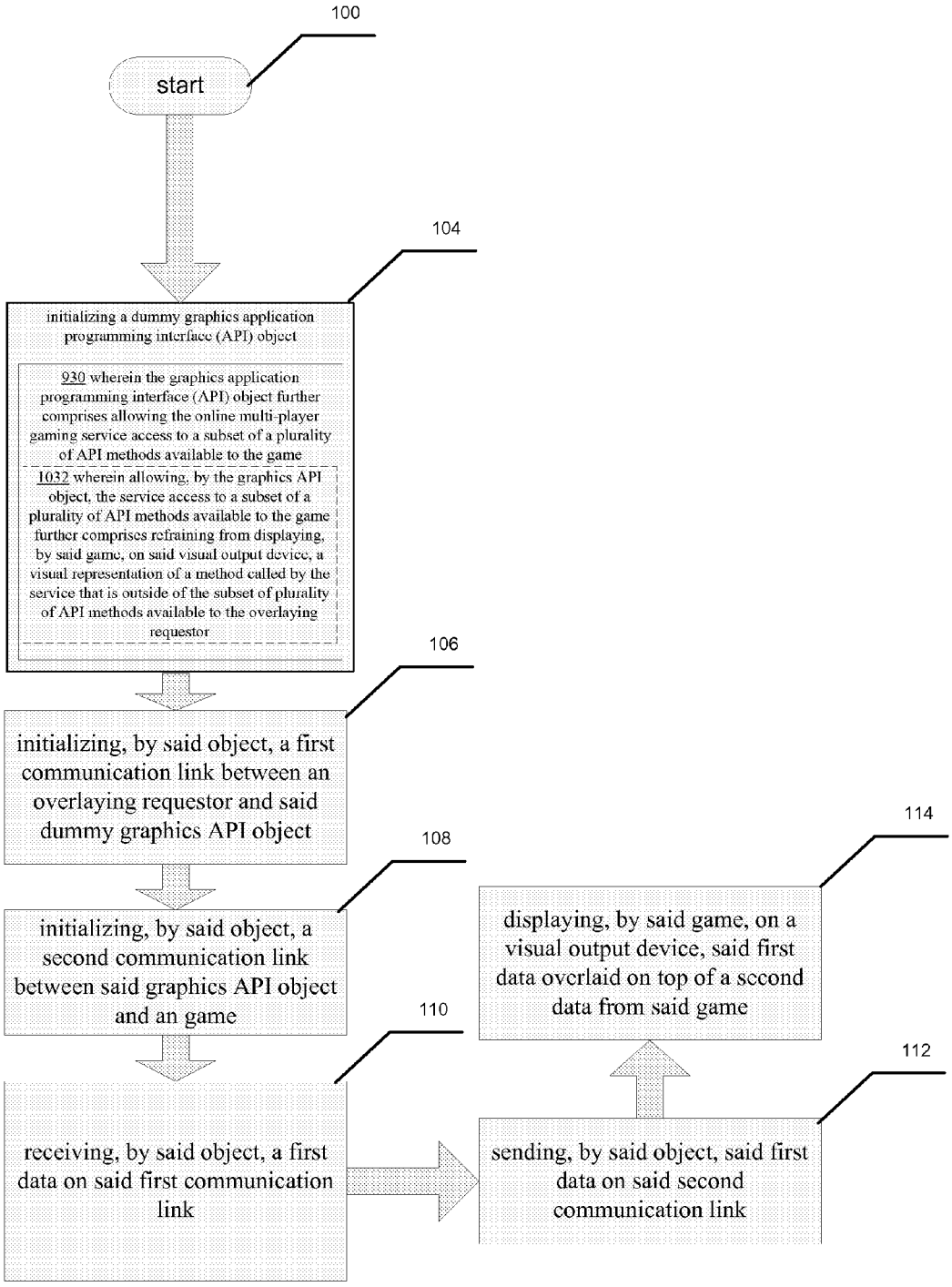
FIG. 10 illustrates an alternative embodiment of the example operational procedure of FIG. 9.

FIG. 10 illustrates an example of the operational procedure 100 of FIG. 9 including an alternative operation including 1032. In this example, allowing the overlaying requester access to a subset of a plurality of API methods available to the game includes refraining from displaying, by said game, on said visual output device, a visual representation of a method called by the overlaying requester that is outside of the subset of plurality of API methods available to the overlaying requester. In an embodiment of the present disclosure, this may be, but is not limited to, ignoring all such called methods that are outside of the available subset of methods. In another embodiment, an exception could be raised and the process could quit. This would be appropriate in situations where the call of an un-allowed method would be unequivocal of the system being compromised or otherwise damaged.

Figure 11:
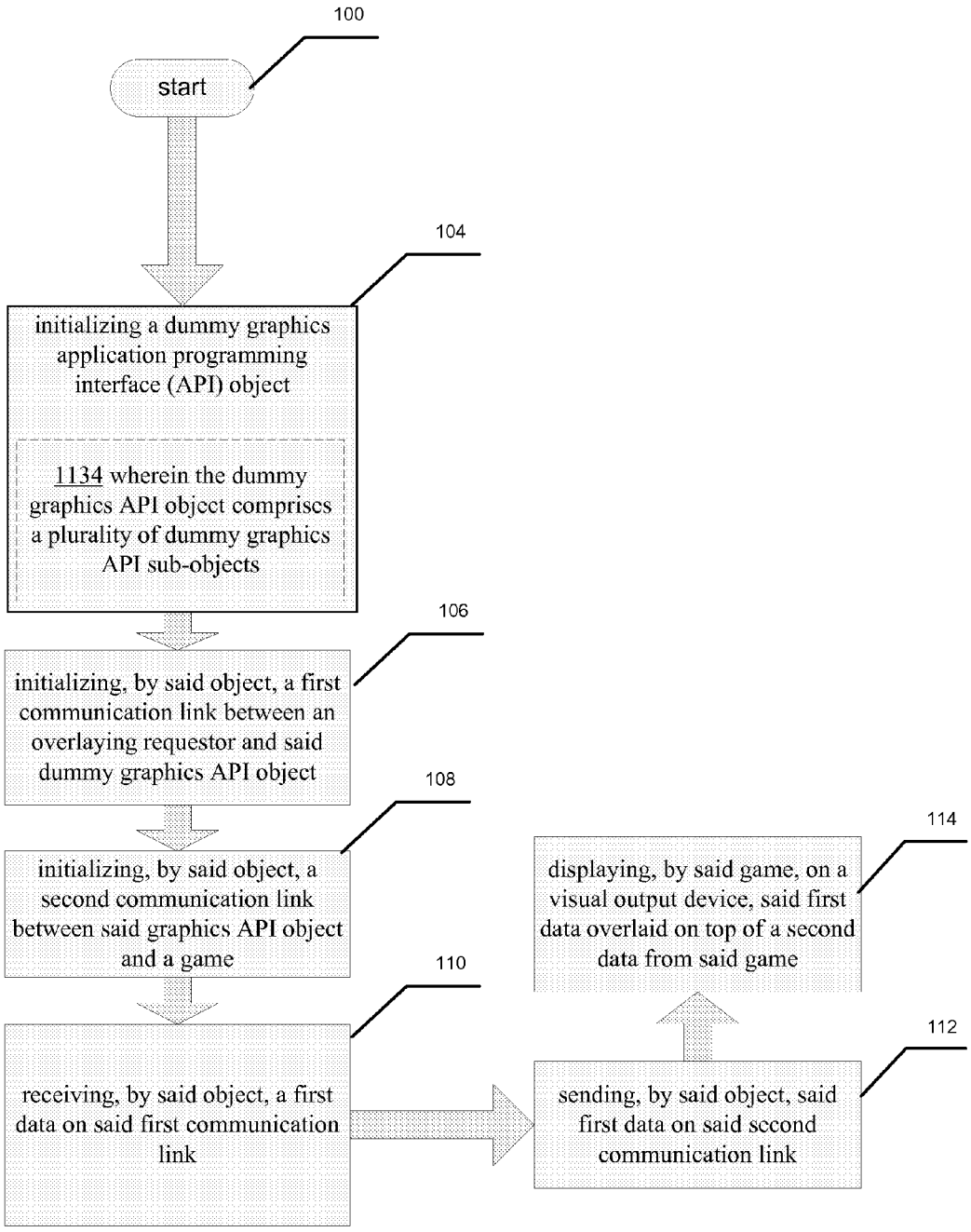
FIG. 11 illustrates an alternative embodiment of the example operational procedure of FIG. 1.

FIG. 11 illustrates an example of the operational procedure 100 of FIG. 9 including an alternative operation including 1134. In this example, the dummy graphics application programming interface (API) object includes a plurality of dummy graphics application programming interface (API) sub-objects. In an embodiment of the present disclosure, this may be, but is not limited to, a dummy graphics API object that corresponds to each of a plurality of visual output devices. In another embodiment, each dummy graphics API objects may correspond to each of a plurality of real graphics API objects on the game. In still another embodiment, each dummy graphics API object may correspond to a single real graphics API object on each of a plurality of games.

Figure 12:
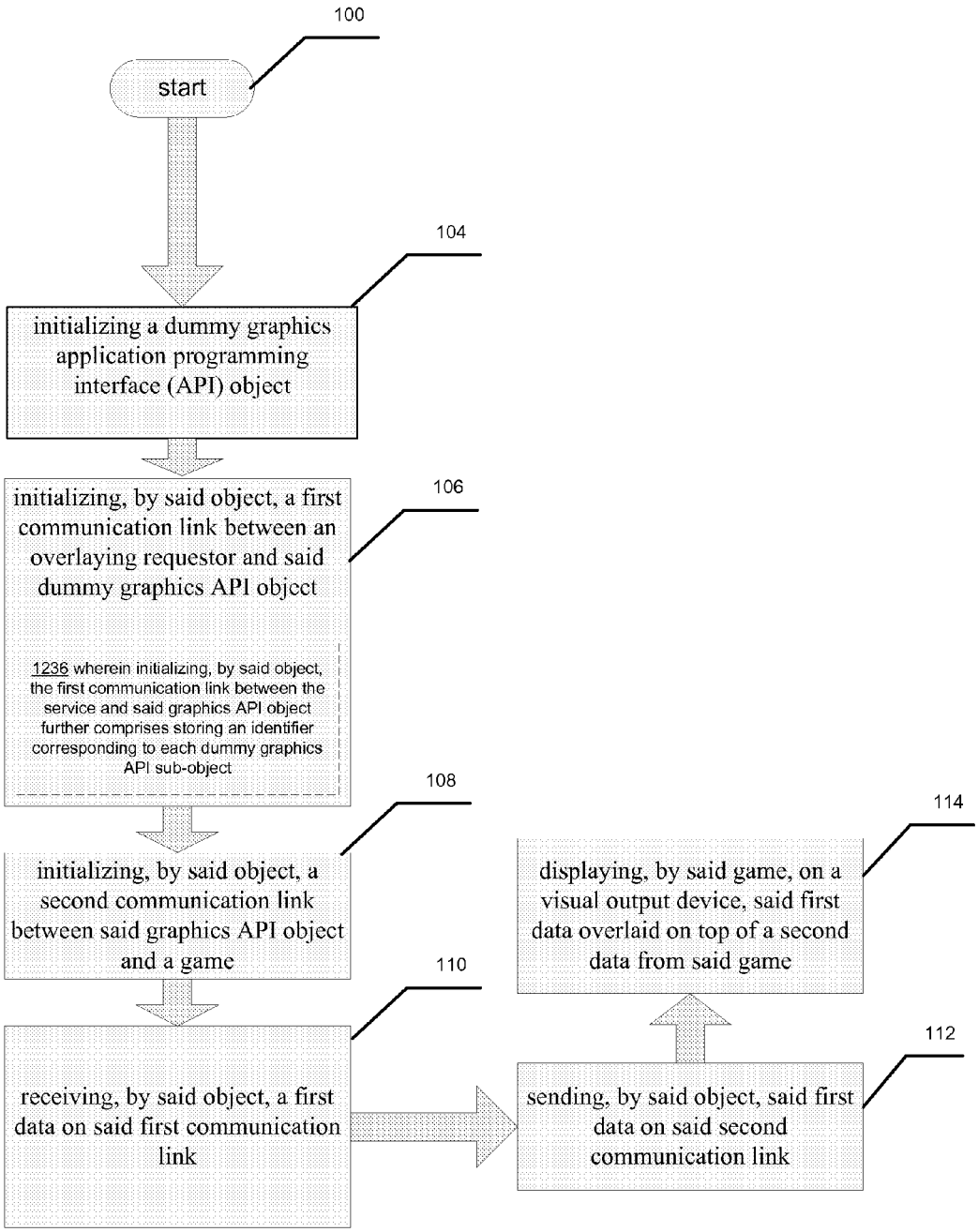
FIG. 12 illustrates an alternative embodiment of the example operational procedure of FIG. 11.

FIG. 12 illustrates an example of the operational procedure 100 of FIG. 9 including an alternative operation including 1236. In this example, initializing, by said graphics API object, a first communication link between an overlaying requester and said dummy graphics API object includes storing an identifier corresponding to each dummy graphics application programming interface (API) sub-object. In an embodiment of the present disclosure, this may be, but is not limited to, maintaining a data table in computer memory of pairs, where on item in the pair is a pointer to a dummy graphics API sub-object and the other item in the pair is an integer that corresponds to that dummy graphics API sub-object.

Figure 13:
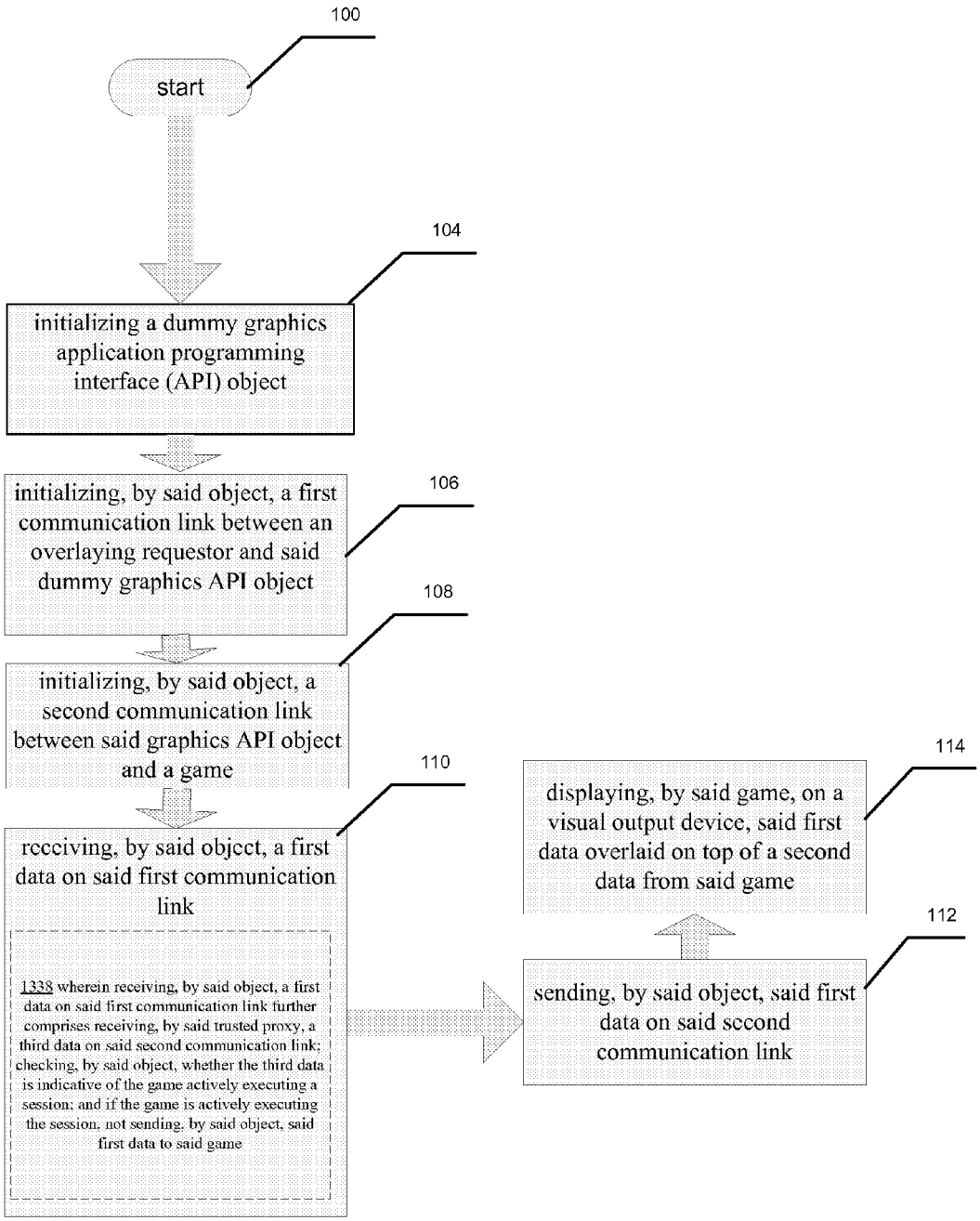
FIG. 13 illustrates an alternative embodiment of the example operational procedure of FIG. 1.

FIG. 13 illustrates an example of the operational procedure 100 of FIG. 9 including an alternative operation including 1338. In this example, receiving, by said graphics API object, a first data on said first communication link includes receiving, by said graphics API object, a third data on said second communication link, checking, by said graphics API object, whether the third data is indicative of the game actively executing a game-play session and if the game is actively executing the game-play session, not sending, by said graphics API object, said first data to said game. In an embodiment of the present disclosure, this may be, but is not limited to, displaying an overlay only when the game-play session is paused. For example, where real-time interaction by the player is required, such as in a first-person shooter-type game, and the user wants to change his system preferences, calling up the systems preferences screen would not be possible during active game-play because it may materially affect the outcome of the game.

Figure 14:
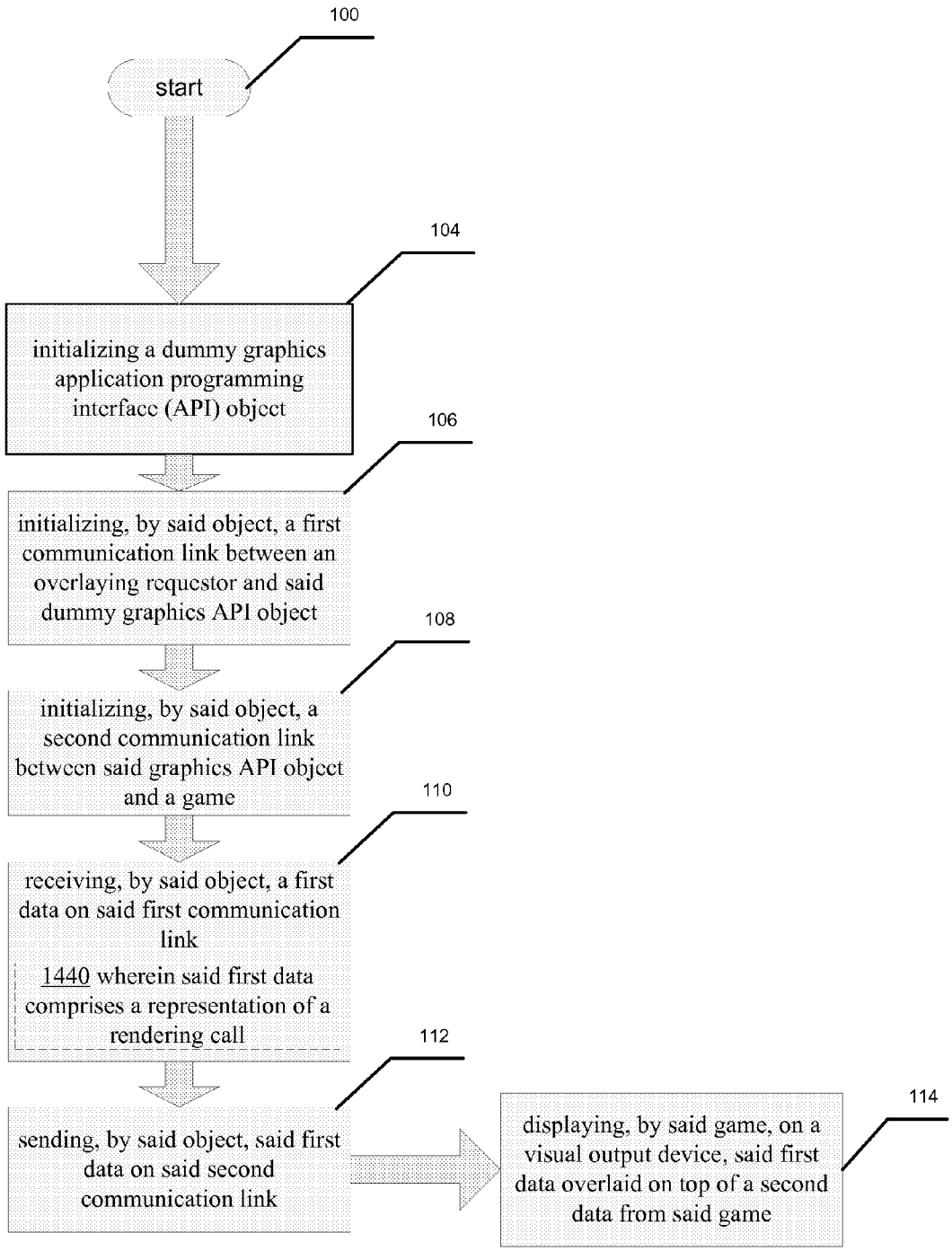
FIG. 14 illustrates an alternative embodiment of the example operational procedure of FIG. 1.

FIG. 14 illustrates an example of the operational procedure 100 including an alternative operation including 1440. In this example, a first data includes a representation of a rendering call. In an embodiment of the present disclosure, this may be, but is not limited to, a call to such methods as creating a texture, creating a pixel shader, creating a vertex shader, creating a vertex declaration, setting a rendering state, setting a sampler state, setting a vertex shader constant, setting a pixel shader constant, setting a vertex declaration, setting a vertex shader, setting a pixel shader, setting a texture, and drawing a primitive.

Figure 15:
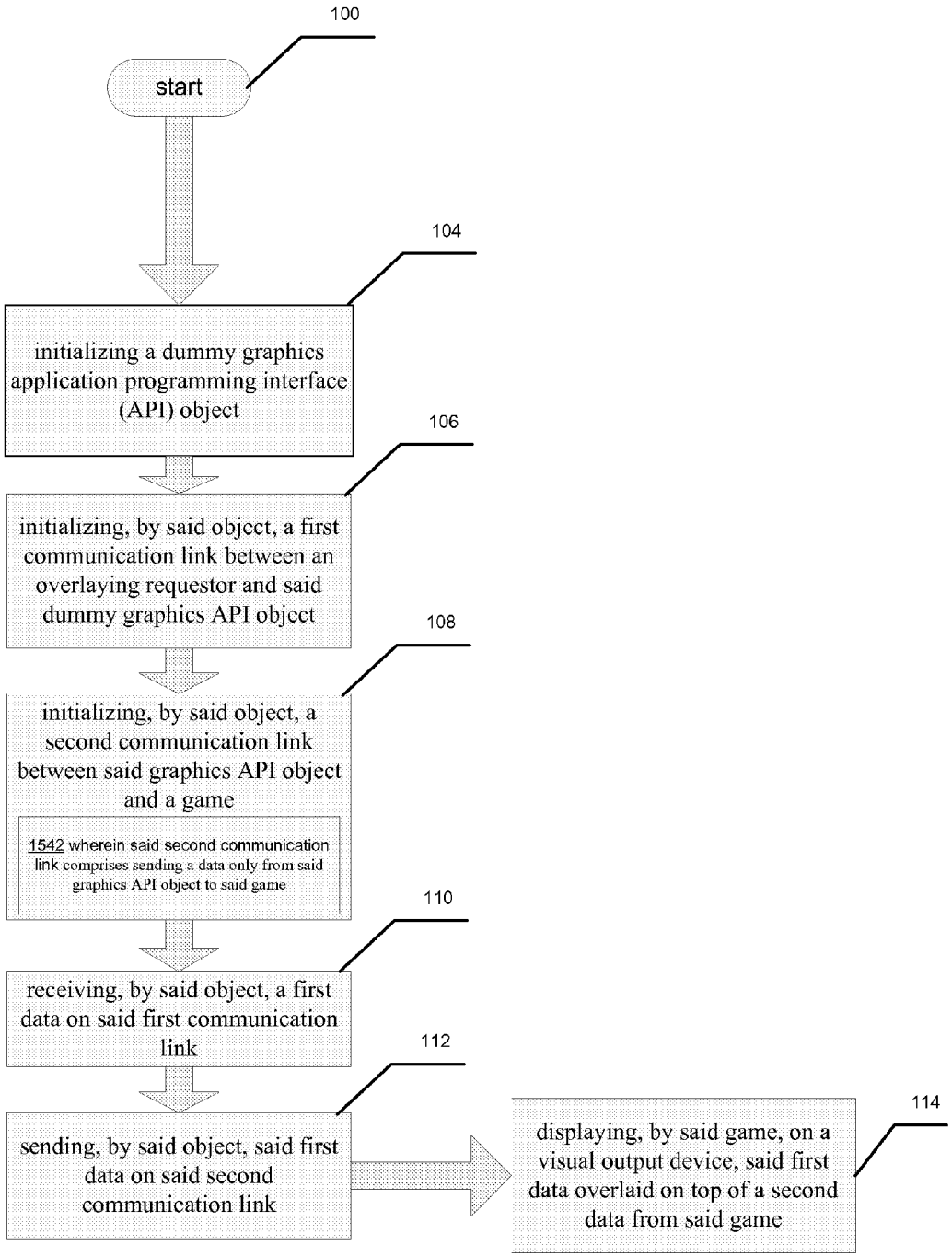
FIG. 15 illustrates an alternative embodiment of the example operational procedure of FIG. 1.

FIG. 15 illustrates an example of the operational procedure 100 including an alternative operation including 1848. In this example, a second communication link includes sending a data only from said graphics API object to said game. In an embodiment of the present disclosure, this may be, but is not limited to, allowing communication only in that one direction and ignoring or rejecting all attempted passing of data from the game to the graphics API object.

Figure 16:
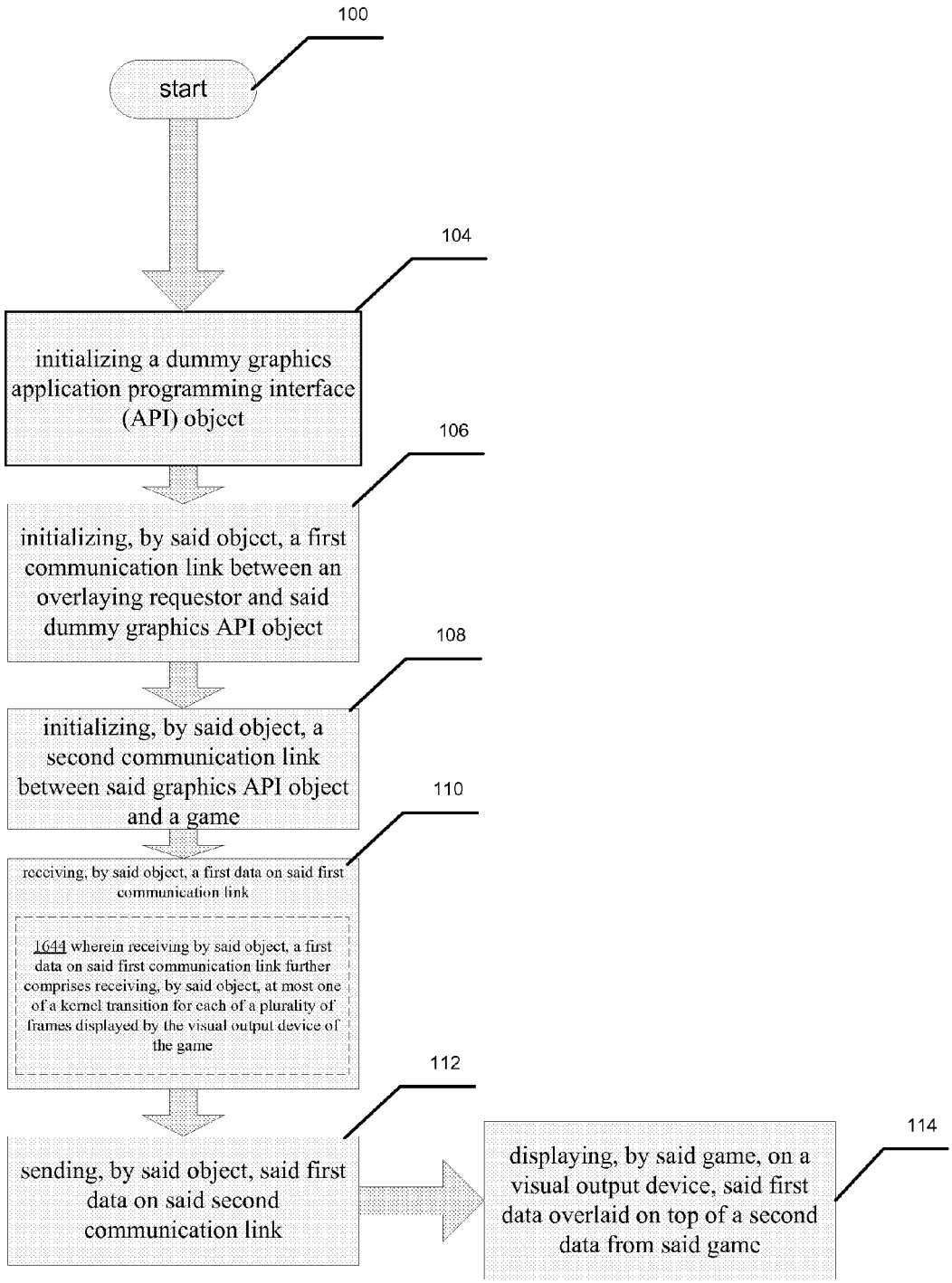
FIG. 16 illustrates an alternative embodiment of the example operational procedure of FIG. 1.

FIG. 16 illustrates an example of the operational procedure 100 including an alternative operation including 1644. In this example, receiving, by said graphics API object, a first data on said first communication link includes receiving, by said graphics API object, at most one of a kernel transition for each of a plurality of frames displayed by the visual output device of the game. In an embodiment of the present disclosure, this may be, but is not limited to, checking for notifications from the online multi-player service.

FIG. 17 illustrates an example of the operational procedure 100 including an alternative operation including 1746. In this example, receiving, by said graphics API object, a first data on said first communication link includes parsing, by said graphics API object, said first data to determine whether said first data represents a valid command and shutting down, by said graphics API object, said graphics API object if said first data does not represent a valid command. In an embodiment of the present disclosure, this may be, but is not limited to, using regular expression matching to break the first data into its component elements, and comparing the component element that represents the command requested against a table of allowable commands. If the command requested in the first data does not appear in the graphics API object, the graphics API object will halt execution and shut itself down.

FIG. 18 illustrates various components of a system that may embody an operating environment for a computerized gaming system 1848 which allows an game to use an online multi-player gaming service. The computerized gaming system 1850 itself comprises a processor 1852, a computer readable medium having a first stored instructions executable by said processor, said first instructions configured to cause said processor to exchange game information with an overlaying requester 1854 and the computer readable medium having a second stored instructions further launching a graphics API object configured to intercept a first data transferred between the game and the overlaying requester 1856. The computerized gaming system may establish a communication link 1858 with a game 1860. The computerized gaming system may also establish a second communication link 1862 with an overlaying requester 1864.

FIG. 19 illustrates an exemplary system for implementing aspects of the presently disclosed subject matter, including a general purpose computing device in the form of a computer 1941. Components of computer 1941 may include, but are not limited to, a processing unit 1959, a system memory 1922, a graphics processing unit 1929 (and a graphics interface 1931), a video memory 1930 (and a video interface 1932), and a system bus 1921 that couples various system components including the system memory 1922 to the processing unit 1959. The system bus 1921 may be any of several types of bus structures, including a memory bus or memory controller, a peripheral bus, and a local bus using any of a variety of bus architectures. By way of example and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus (also known as Mezzanine bus).

Computer 1941 typically includes a variety of computer-readable media. Computer-readable media can be any available media that can be accessed by computer 1941, and includes both volatile and nonvolatile media, removable and non-removable media. By way of example and not limitation, computer-readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, random access memory (RAM), read-only memory (ROM), electronically erasable programmable read-only memory (EEPROM), flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 1941.

Communication media typically embodies computer readable instructions, data structures, program modules or other data in a modulated data signal such as a carrier wave or other transport mechanism, and includes any information delivery media. The term "modulated data signal" means a signal that has one or more of its characteristics set or changed in such a manner as to encode information in the signal. By way of example and not limitation, communication media includes wired media such as a wired network or direct-wired connection, and wireless media such as acoustic, RF, infrared and other wireless media. Combinations of the any of the above should also be included within the scope of computer readable media.

The system memory 1922 includes computer storage media in the form of volatile and/or nonvolatile memory such as read only memory (ROM) 1923 and random access memory (RAM) 1960. A basic input/output system 1924 (BIOS), containing the basic routines that help to transfer information between elements within computer 1941, such as during start-up, is typically stored in ROM 1923. RAM 1960 typically contains data and/or program modules that are immediately accessible to and/or presently being operated on by processing unit 1959. By way of example and not limitation, FIG. 19 illustrates operating system 1925, application programs 1926, other program modules 1927, and program data 1928.

The computer 1941 may also include other removable/non-removable, volatile/nonvolatile computer storage media. By way of example only, FIG. 19 illustrates a hard disk drive 1938 that reads from or writes to non-removable, nonvolatile magnetic media, a magnetic disk drive 1939 that reads from or writes to a removable, nonvolatile magnetic disk 1954, and an optical disk drive 1940 that reads from or writes to a removable, nonvolatile optical disk 1953 such as a CD-ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 1938 is typically connected to the system bus 1921 through a non-removable memory interface such as interface 1934, and magnetic disk drive 1939 and optical disk drive 1940 are typically connected to the system bus 1921 by a removable memory interface, such as interface 1935.

The drives and their associated computer storage media discussed above and illustrated in FIG. 19 provide storage of computer readable instructions, data structures, program modules and other data for the computer 1941. In FIG. 19, for example, hard disk drive 1938 is illustrated as storing operating system 1958, application programs 1957, other program modules 1956, and program data 1955. Note that these components can be either the same as or different from operating system 1925, application programs 1926, other program modules 1927, and program data 1928. Operating system 1958, application programs 1957, other program modules 1956, and program data 1955 are given different numbers here to illustrate that, at a minimum, they are different copies. A user may enter commands and information into the computer 1941 through input devices such as a keyboard 1951 and pointing device 1952, commonly referred to as a mouse, trackball or touch pad. Other input devices (not shown) may include a microphone, joystick, game pad, satellite dish, scanner, or the like. These and other input devices are often connected to the processing unit 1959 through a user input interface 1936 that is coupled to the system bus, but may be connected by other interface and bus structures, such as a parallel port, game port or a universal serial bus (USB). A monitor 1942 or other type of display device is also connected to the system bus 1921 via an interface, such as a video interface 1932. In addition to the monitor, computers may also include other peripheral output devices such as speakers 1944 and printer 1943, which may be connected through an output peripheral interface 1933.

The computer 1941 may operate in a networked environment using logical connections to one or more remote computers, such as a remote computer 1946. The remote computer 1946 may be a personal computer, a server, a router, a network PC, a peer device or other common network node, and typically includes many or all of the elements described above relative to the computer 1941, although only a memory storage device 1947 has been illustrated in FIG. 19. The logical connections depicted in FIG. 19 include a local area network (LAN) 1945 and a wide area network (WAN) 1949, but may also include other networks. Such networking environments are commonplace in offices, enterprise-wide computer networks, intranets and the Internet.

When used in a LAN networking environment, the computer 1941 is connected to the LAN 1945 through a network interface or adapter 1937. When used in a WAN networking environment, the computer 1941 typically includes a modem 1950 or other means for establishing communications over the WAN 1949, such as the Internet. The modem 1950, which may be internal or external, may be connected to the system bus 1921 via the user input interface 1936, or other appropriate mechanism. In a networked environment, program modules depicted relative to the computer 1941, or portions thereof, may be stored in the remote memory storage device. By way of example and not limitation, FIG. 19 illustrates remote application programs 1948 as residing on memory device 1947. It will be appreciated that the network connections shown are exemplary and other means of establishing a communications link between the computers may be used.

It should be understood that the various techniques described herein may be implemented in connection with hardware or software or, where appropriate, with a combination of both. Thus, the methods and apparatus of the presently disclosed subject matter, or certain aspects or portions thereof, may take the form of program code (i.e., instructions)

embodied in tangible media, such as floppy diskettes, CD-ROMs, hard drives, or any other machine-readable storage medium wherein, when the program code is loaded into and executed by a machine, such as a computer, the machine becomes an apparatus for practicing the presently disclosed subject matter. In the case of program code execution on programmable computers, the computing device generally includes a processor, a storage medium readable by the processor (including volatile and non-volatile memory and/or storage elements), at least one input device, and at least one output device. One or more programs may implement or utilize the processes described in connection with the presently disclosed subject matter, e.g., through the use of an API, reusable controls, or the like. Such programs are preferably implemented in a high-level procedural or object oriented programming language to communicate with a computer system. However, the program(s) can be implemented in assembly or machine language, if desired. In any case, the language may be a compiled or interpreted language, and may be combined with hardware implementations.

The foregoing detailed description has set forth various embodiments of the systems and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein.

What is claimed:

1. A method for overlaying graphics from an overlaying requestor on top of a game's visual output via a graphics proxy, comprising:

initializing a dummy graphics application programming interface (API) object;

initializing, by said graphics API object, a first communication link between an overlaying requestor and said dummy graphics API object;

initializing, by said graphics API object, a second communication link between said graphics API object and a game;

receiving, by said graphics API object, a first data on said first communication link;

sending, by said graphics API object, said first data on said second communication link to the game that displays on a visual output device, said first data overlaid on top of a second data from said game.

2. The method of claim 1, wherein sending, by said graphics API object, a first data on said second communication link further comprises:

sending, by said graphics API object, to the game, via a signaling channel a signal indicating that the first data is to be read from a shared memory resource; and sending said first data to said memory resource.

3. The method of claim 2, wherein sending said first data to said memory resource further comprises:

adhering to an inter-process communication (IPC) protocol.

4. The method of claim 3, wherein sending said first data to said memory resource further comprises:

adhering to a component object model (COM) protocol.

5. The method of claim 1, wherein the dummy graphics API object further comprises:

a trusted proxy that is recognized as trusted by the overlaying requestor.

6. The method of claim 1, wherein said first data comprises:

a representation of one of a profile management dialog, a friends list, a message to a user, and a game settings management dialog.

7. The method of claim 1, wherein said first data is overlaid on top of said visual output from said game further comprises:

a synthesis of said first data with a draw call for said visual output from said game.

8. The method of claim 1, wherein sending, by said graphics API object, said first data on said second communication link to said game that displays, on a visual output device, said first data overlaid on top of a visual output from said game further comprises:

sending, by said graphics API object, said first data on said second communication link to said game that displays, on the visual output device, said first data overlaid each time the game displays the visual output on the visual output device.

9. The method of claim 1, wherein initializing the graphics application programming interface (API) object further comprises:

allowing the overlaying requester access to a subset of a plurality of API methods available to the game.

10. The method of claim 9, wherein allowing, by the graphics application programming interface (API) object, the overlaying requester access to a subset of a plurality of API methods available to the game further comprises:

refraining from displaying, by said game, on said visual output device, a visual representation of a method called by the overlaying requester that is outside of the subset of plurality of API methods available to the overlaying requester.

11. The method of claim 1, wherein the dummy graphics application programming interface (API) object comprises:

a plurality of dummy graphics application programming interface (API) sub-objects.

12. The method of claim 1, wherein initializing, by said graphics API object, the first communication link between the overlaying requester and said graphics API object further comprises:

storing an identifier corresponding to each dummy graphics application programming interface (API) sub-object.

13. The method of claim 1, wherein receiving, by said graphics API object, a first data on said first communication link further comprises:

receiving, by said graphics API object, a third data on said second communication link;

checking, by said graphics API object, whether the third data is indicative of the game actively executing a game-play session; and when the game is actively executing the game-play session, not sending, by said graphics API object, said first data to said game.

14. The method of claim 1, wherein the first data comprises:

a representation of a rendering call.

15. The method of claim 1, wherein said second communication link comprises:

a communication link for sending a data only from said graphics API object to said game.

16. The method of claim 1, wherein receiving, by said graphics API object, a first data on said first communication link further comprises:

receiving, by said graphics API object, at most one of a kernel transition for each of a plurality of frames displayed by the visual output device of the game.

17. The method of claim 1, wherein receiving, by said graphics API object, a first data on said first communication link further comprises:

parsing, by said graphics API object, said first data to determine whether said first data represents a valid command; and shutting down, by said graphics API object, said graphics API object if said first data does not represent a valid command.

18. A computerized gaming service that allows an overlaying requester that is connected to a game through a graphics API object to overlay drawings on top of the game's visual output, comprising:

a processor;

a computer readable medium having a first stored instructions executable by said processor, said first instructions configured to cause said processor to exchange game information with an overlaying requester; and the computer readable medium having a second stored instructions further launching a graphics API object configured to intercept a first data transferred between the game and the overlaying requester.

19. A computer readable medium excluding signals having a plurality of computer executable instructions, comprising instructions for:

executing a dummy graphics application programming interface (API) object;

enabling a first communication link between an overlaying requester and said graphics API object;

enabling by said graphics API object, a second communication link between a game and said graphics API object;

receiving, by the graphics API object from the overlaying requester, a first data;

sending, by said graphics API object, said first data on said second communication link; and causing said game to display, on a visual output device, said first data overlaid on top of a second data from said game.

20. The computer readable medium of claim 19, said instructions further causing the processor to perform the steps of:

synthesizing said first data with a draw call for said visual output from said game.

* * * * *

UNITED STATES PATENT AND TRADEMARK OFFICE

CERTIFICATE OF CORRECTION

PATENT NO. : 8,120,622 B2
APPLICATION NO. : 12/014691
DATED : February 21, 2012
INVENTOR(S) : Shawn Hargreaves et al.

It is certified that error appears in the above-identified patent and that said Letters Patent is hereby corrected as shown below:

In the Specification

Column 1, line 67, after "said" insert -- game. --.

Signed and Sealed this
Third Day of February, 2015

Michelle K. Lee

Michelle K. Lee
*Deputy Director of the United States Patent and Trademark Office*